US006217429B1

(12) United States Patent
Hoey

(10) Patent No.: US 6,217,429 B1
(45) Date of Patent: Apr. 17, 2001

(54) POLISHING PAD CONDITIONER

(75) Inventor: Gee Sun Hoey, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/350,970

(22) Filed: Jul. 9, 1999

(51) Int. Cl.[7] ..... B24B 21/18; B24B 33/00; B24B 47/26

(52) U.S. Cl. ..... 451/443; 451/56

(58) Field of Search ..... 451/56, 41, 285, 451/287, 288, 42, 443, 444, 548, 540

(56) References Cited

U.S. PATENT DOCUMENTS 5,081,795 * 1/1992 Tanaka et al. ..... 451/285
5,456,627 * 10/1995 Jackson et al. ..... 451/56
5,486,131 * 1/1996 Cesna et al. ..... 451/443
5,667,443 * 9/1997 Mallon ..... 451/56
5,683,289 * 11/1997 Hempel et al. ..... 451/56
5,749,771 * 5/1998 Isobe ..... 451/444
6,001,008 * 12/1999 Fujimori et al. ..... 451/444

* cited by examiner

*Primary Examiner*—Derris H. Banks
(74) *Attorney, Agent, or Firm*—Fish & Richardson

(57) ABSTRACT

A conditioner head to condition the polishing surface of a polishing pad includes a disk having an abrasive surface to contact a polishing pad. A disk holder carries the disk and holds it in contact with the polishing pad. The disk holder has a generally flat mounting surface. A drive element rotates the disk about an axis.

13 Claims, 9 Drawing Sheets

POLISHING PAD CONDITIONER

BACKGROUND

This invention relates generally to the planarization of semiconductor substrates and, more particularly to the conditioning of polishing pads.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: substrate surface planarity and uniformity, and the polishing rate. Inadequate planarity and uniformity can produce substrate defects. The polishing rate sets the time needed to polish a layer. Thus, it sets the maximum throughput of the polishing apparatus.

It is important to take appropriate steps to counteract any deteriorative factors which either present the possibility of damaging the substrate (such as by scratches resulting from accumulated debris in the pad) or reduce polishing speed and efficiency (such as results from glazing of the pad surface after extensive use). The problems associated with scratching the substrate surface are self-evident. The more general pad deterioration problems both decrease polishing efficiency, which increases cost, and create difficulties in maintaining consistent operation from substrate to substrate as the pad decays.

The glazing phenomenon is a complex combination of contamination, thermal, chemical and mechanical damage to the pad material. When the polisher is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to apply fresh slurry to the substrate.

It is, therefore, desirable to continually condition the pad by removing trapped slurry, and unmatting or re-expanding the pad material.

A conventional conditioning apparatus places an abrasive material in contact with the moving polishing pad. For example, a diamond coated screen or disk may be used to scrape and abrade the pad surface, and to expand and re-roughen the pad. The diamond coated disk can be attached to a rotatable backing element.

Two manufacturers of diamond coated disks are Abrasive Technology, Inc., of Westerville, Ohio, and TBW Industries, Inc. of Furlong, Penn. The disks from Abrasive Technology are thicker than those of TBW. Also, mechanical means are used to secure the Abrasive Technology disks to the backing element, whereas magnetic means are used to secure the TBW disks to the backing element. Different disk holders are needed to hold these different types of disks.

SUMMARY

In one aspect, the invention is directed to a conditioner head to condition the polishing surface of a polishing pad. The conditioner head has a disk having an abrasive surface to contact a polishing pad, a disk holder to carry the disk and to hold it in contact with the polishing pad, and a drive element to rotate the disk about an axis. The disk holder has a generally flat mounting surface.

Implementations of the invention may include one or more of the following features. A mechanical fastener may secure the disk to the disk holder. The mechanical fastener may include a plurality of holes provided around a periphery of the disk holder. The holes may extend through the disk holder. A plurality of first cavities may be provided around a periphery of the disk corresponding to the plurality of holes of the disk holder. A plurality of screws may be inserted into the plurality of holes and the plurality of first cavities to secure the disk to the disk holder. The disk holder may include an upwardly protruding rim. A ring may be positioned on the rim of the disk holder, and the ring may have a plurality of holes at its edges. A membrane cover may be secured between the ring and the rim to prevent contaminants from falling into an interior of the disk holder. Each of the plurality of holes on the ring may include an upper cavity and a lower cavity, with the lower cavity extending radially further into the ring than the upper cavity. The disk holder may include a generally convex spherical portion protruding upward on an opposing side of the mounting surface. The disk holder may be secured to the disk by a plurality screws. A plurality of drive pins on the disk receiving surface of the disk holder may transfer torque to the disk, and a plurality of drive bores on the disk may receive the drive pins. A generally annular, flat adapter may be positioned between the disk and the disk holder. A plurality of second cavities may be provided around a periphery of the adapter to correspond to the plurality of holes of the disk holder, and a plurality of screws may be inserted into the plurality of holes and the plurality of second cavities to secure the adapter to the disk holder. The adapter may include a plurality of drive bores to receive the drive pins of the disk holder. The disk holder may include a generally convex spherical portion protruding upward on an opposing side of the mounting surface. A generally flat lower surface of the disk may be secured to the adapter and the disk holder defines a disk plane, and the disk, the adapter and the disk holder may be configured such that the center of the spherical portion is located substantially at the disk plane. A magnetic plate may be positioned between the adapter and the disk to magnetically couple the disk to the adapter.

In another aspect, the invention is directed to a disk holder of a conditioner head to carry and hold an abrasive disk against a polishing surface of a polishing pad. The disk holder has a generally convex spherical portion protruding upward from an upper surface of the disk holder, a generally flat mounting surface provided on a lower surface of the disk holder, and a plurality of holes around a periphery of the disk holder. The holes are configured to receive a plurality of screws which are used to secure the disk or an adapter to the mounting surface of the disk holder.

In another aspect, the invention is directed to a conditioner head to condition the polishing surface of a polishing pad. The conditioner head has a disk having an abrasive surface to contact a polishing pad, a disk holder to carry the disk and to hold it in contact with the polishing pad, and a drive element to rotate the disk about a longitudinal axis. The disk holder has a generally flat mounting surface on one side and a generally convex spherical portion protruding upward on an opposing side of the mounting surface. A generally flat adapter is secured to the disk on one side and mounted to the mounting surface of the disk holder on an opposing side thereof. A generally flat lower surface of the disk secured to the adapter and the disk holder defines a disk plane, and the disk, the adapter and the disk holder are configured such that the center of the spherical portion is located substantially at the disk plane.

In another aspect, the invention is directed to a conditioner head to condition the polishing surface of a polishing pad. The conditioner head has a disk having an abrasive surface to contact a polishing pad, a disk holder to carry the disk and to hold it in contact with the polishing pad, and a drive element to rotate the disk about a longitudinal axis. The disk has a plurality of cavities at its periphery, and the disk holder has a generally flat mounting surface to mount the disk thereon and a plurality of holes at its periphery. A plurality of screws are inserted into the plurality of holes and the plurality of cavities to secure the disk and the disk holder together.

Advantages of the invention may include the following. The disk holder of the present invention may carry the disks of different thicknesses, including disks manufactured by both Abrasive Technology and TBW. The disk holder allows either magnetic or mechanical means to secure the disks to the backing element.

Other advantages and features of the invention will be apparent from the following description, including the drawings and claims.

BRIEF DESCRIPTION OF THE DRAWINGS

Like reference numbers and designations in the various drawings indicate like elements. A primed reference number indicates that an element has a modified function, operation or structure.

DETAILED DESCRIPTION

Figure 1:
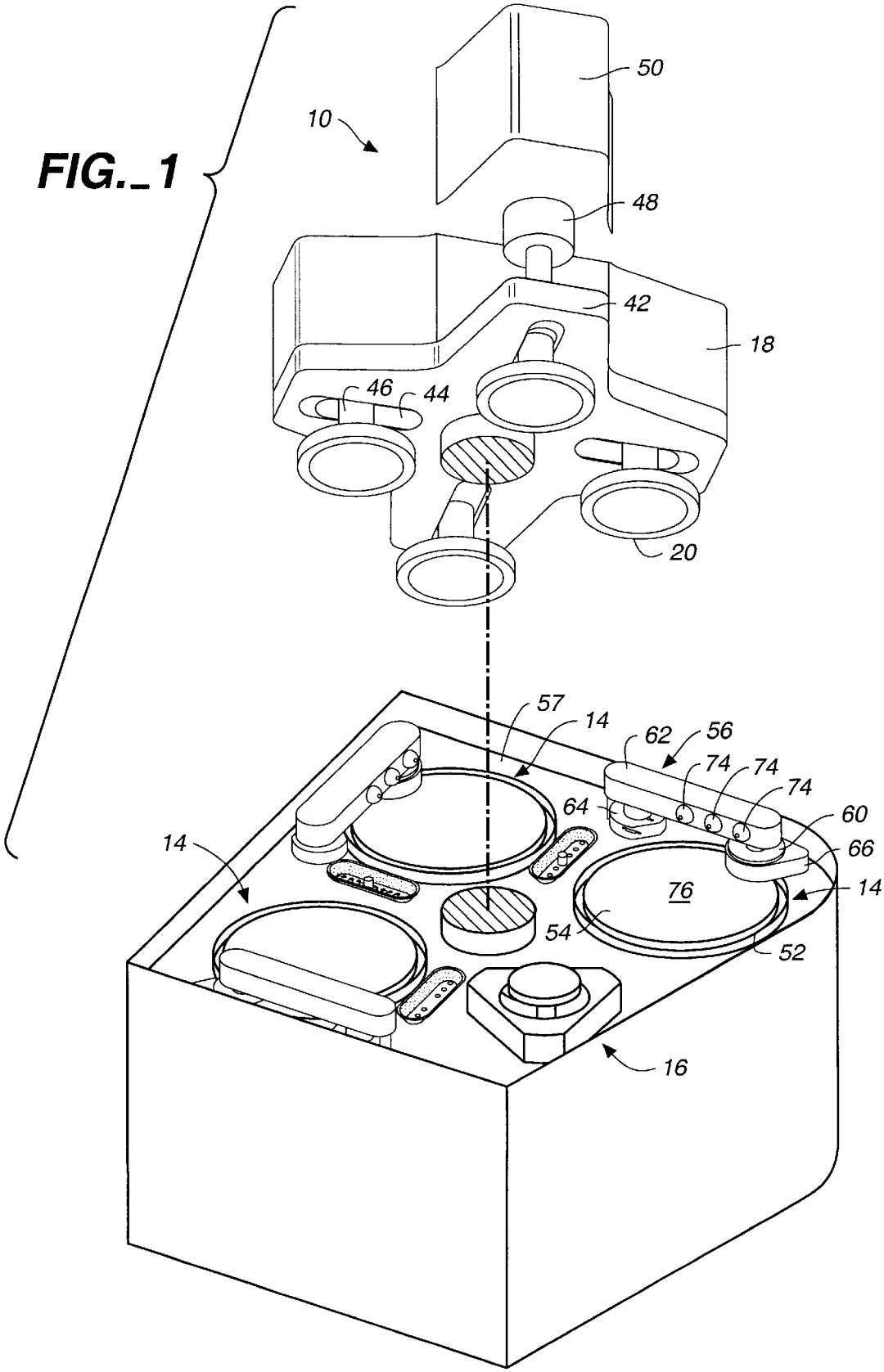
FIG. 1 is a partially exploded view of the polishing apparatus of FIG. 1.

Referring to FIG. 1, a polishing apparatus 10 includes three independently-operated polishing stations 14, a substrate transfer station 16, and a rotatable carousel 18 which choreographs the operation of four independently rotatable carrier heads 20.

The carousel 18 has a support plate 42 with slots 44 through which shafts 46 of the carrier heads 20 extend. The carrier heads 20 can independently rotate and oscillate back-and-forth in the slots 44 to achieve a uniformly polished substrate surface. The carrier heads 20 are rotated by respective motors 48, which are normally hidden behind removable sidewalls 50 of the carousel 18. In operation, a substrate is loaded by the transfer station 16 into a carrier head 20. The carousel 18 then transfers the substrate through a series of one or more polishing stations 14 and finally returns the polished substrate to the transfer station 16.

Each polishing station 14 includes a rotatable platen 52, which supports a polishing pad 54, and a pad conditioner 56. The platen 52 and conditioner 56 are both mounted to a table top 57 inside the polishing apparatus 10. Each pad conditioner 56 includes a conditioner head 60, an arm 62, and a base 64. The arm 62 has a distal end coupled to the conditioner head 60 and a proximal end coupled to the base 64. The base 64 rotates to sweep the conditioner head 60 across the polishing pad surface 76 to condition the surface 76. Each polishing station 14 also includes a cup 66, which contains a cleaning liquid for rinsing or cleaning the conditioner head 60.

Figure 2A:
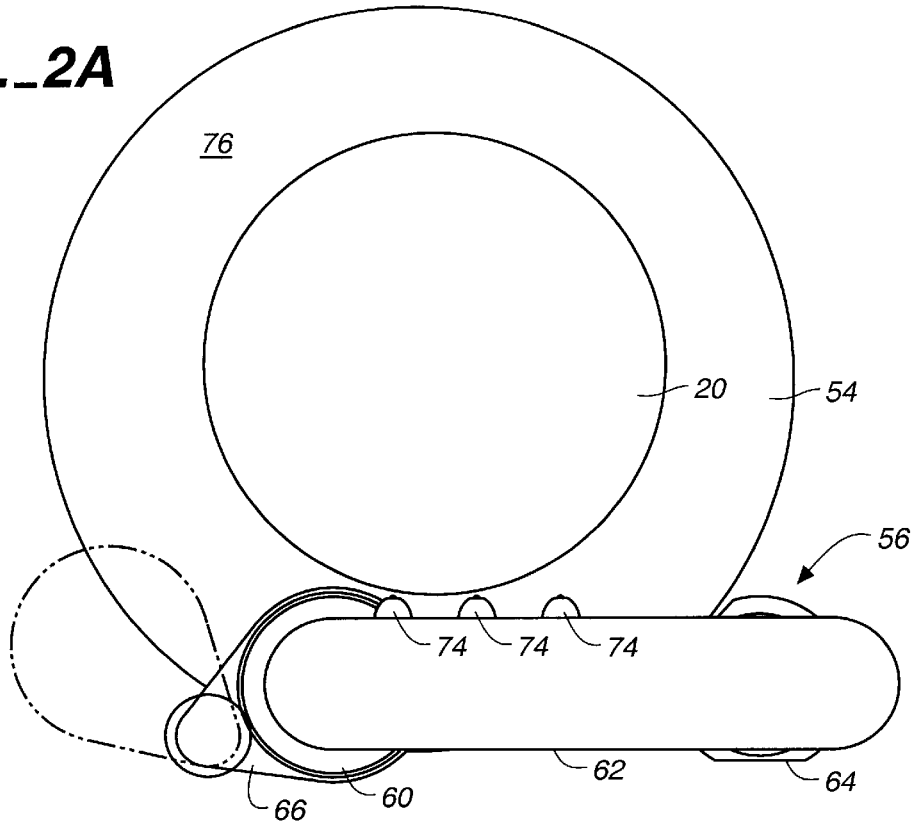
FIGS. 2A and 2B are diagrammatic top views of a substrate being polished and a polishing pad being conditioned by the polishing apparatus of FIG. 1.
Figure 2B:
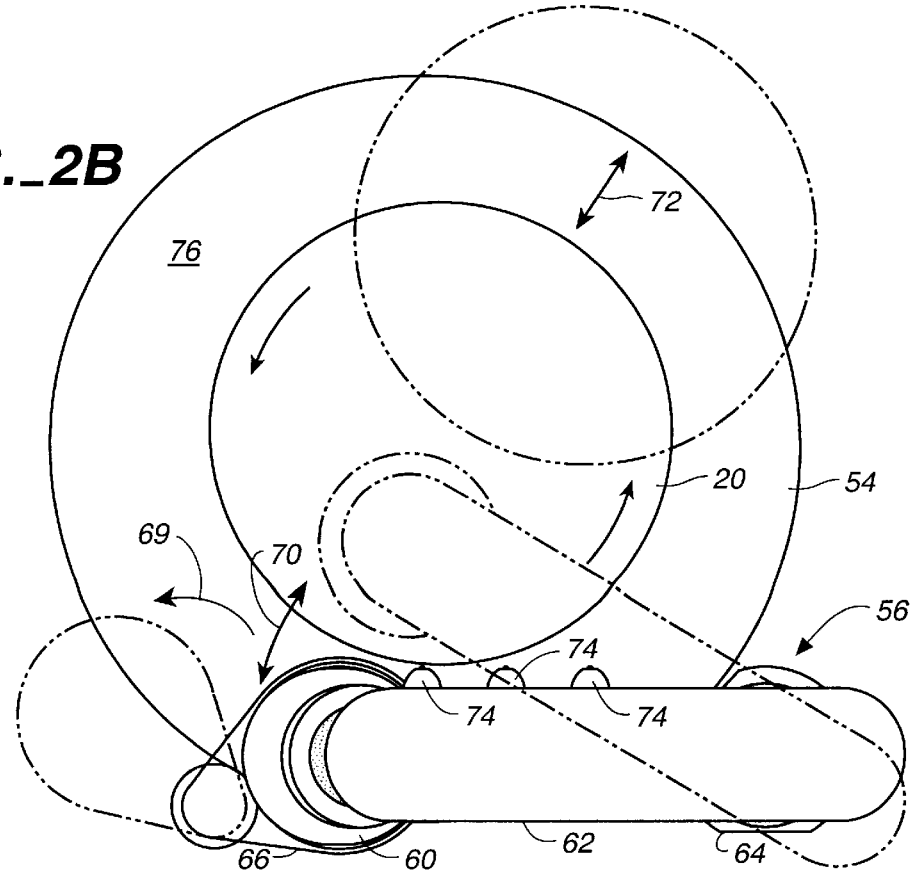

Referring to FIGS. 2A and 2B, in one implementation, a polishing pad 54 is conditioned by a pad conditioner 56. The conditioner head 60 sweeps across the polishing pad 54 with a reciprocal motion that is synchronized with the motion of the carrier head 20 across the polishing pad 54. For example, before polishing, the carrier head 20 may be positioned in the center of the polishing pad 54 and the conditioner head 60 may be immersed in the cleaning liquid contained within the cup 66. During polishing, the cup 66 may pivot out of the way as shown by arrow 69, and the conditioner head 60 and the carrier head 20 may be sweep back-and-forth across the polishing pad 54 as shown by arrows 70 and 72, respectively. Three water jets 74 may direct streams of water toward the polishing pad 54 to rinse slurry from the polishing or upper pad surface 76.

Further details regarding the general features and operation of polishing apparatus 10 may be found in U.S. Pat. No. 5,738,574, the entirety of which is incorporated herein by reference.

Figure 3A:
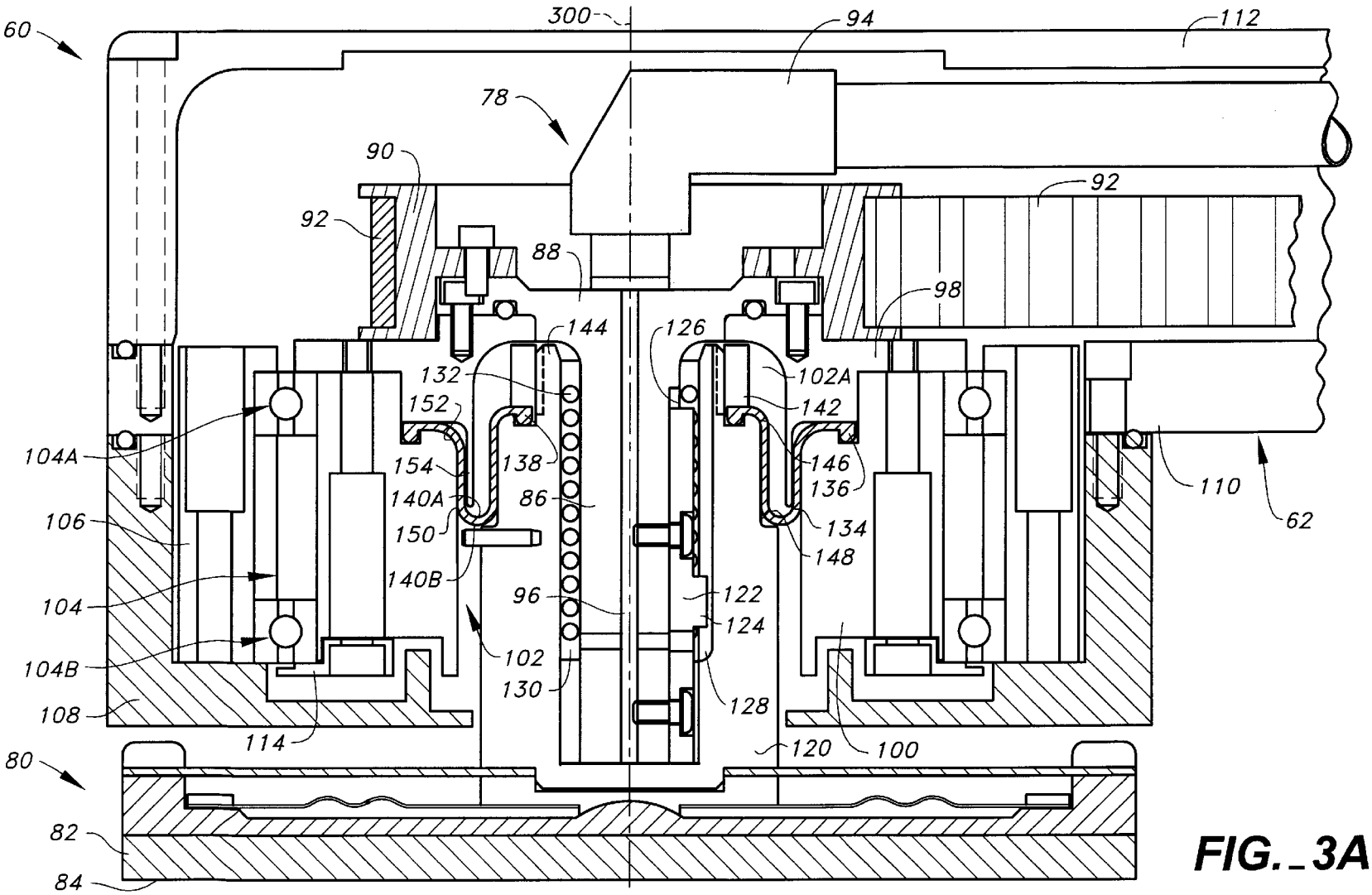
FIG. 3A is a diagrammatic cross-sectional view of a conditioner head with an end effector in a retracted position.
Figure 3B:
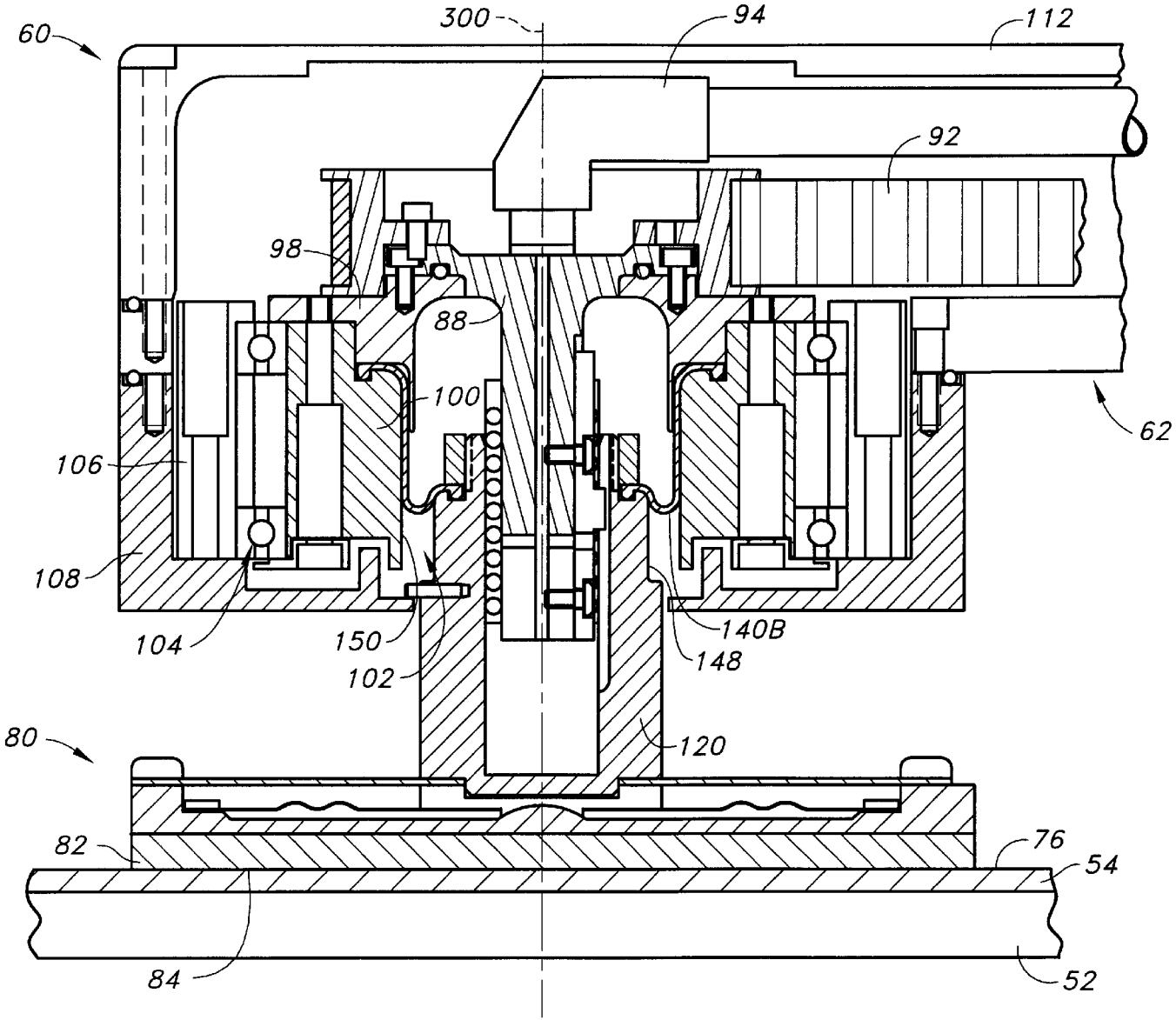
FIG. 3B is a diagrammatic cross-sectional view of a conditioner head with an end effector in an extended position.

Referring to FIGS. 3A and 3B, a conditioner head 60 includes an actuation and drive mechanism 78 which rotates an end effector 80 carrying a diamond impregnated conditioning disk 82 (manufactured, for example, by Abrasive Technology) about a central vertically-oriented longitudinal axis 300 of the head. The actuation and drive mechanism further provides for the movement of the end effector 80 and disk 82 between an elevated retracted position (FIG. 3A) and a lowered extended position (FIG. 3B). In the substantially extended position, the lower surface 84 of the disk 82 may be brought into engagement with the polishing surface 76 of the pad 54.

The actuation and drive mechanism 78 includes a vertically-extending drive shaft 86 which, at its upper end, includes a unitarily-formed, radially-extending web 88. In the exemplary embodiment, the drive shaft may be formed of heat treated 440C stainless steel. A pulley 90 is secured to the web and carries a belt 92 which extends along the length of the arm 62 and is coupled to a remote motor (not shown) for rotating the shaft 86 about the longitudinal axis 300. A rotary union 94 is secured to the upper end of the shaft for introducing and withdrawing air from an actuation chamber via a longitudinal channel 96 in the shaft. A collar, having upper and lower pieces 98 and 100, respectively, coaxially encompasses the shaft, defining a generally annular space 102 therebetween. The upper collar piece 98 depends from the web 88. The shaft, pulley, and collar form a generally rigid structure which rotates as a unit about the longitudinal axis 300. To permit rotation, the shaft/pulley/collar unit is carried within the head by a bearing system 104 comprising upper and lower ball bearing units 104A and 104B. The bearing system 104 couples the lower collar 100 of the collar piece to an inner head housing 106 which is fixed to the structure of the arm. An annular clamp 114 is secured to the base of lower collar piece 100 so as to vertically clamp an inner portion of the bearing system 104 between the clamp 114 and upper collar piece 98. The inner head housing 106 is held within a centrally-apertured cup-shaped outer head housing 108 and secured thereto to vertically clamp an outer portion of the bearing system 104 between the inner and outer head housings. The outer head housing 108 is secured to a lower arm housing 110 so that the arm 62 supports the head 60. An upper arm housing 112 provides additional structural support.

A generally-annular drive sleeve 120 couples the end effector 80 to the drive shaft 86. The drive sleeve 120 is accommodated within the annular space 102 between the collar and drive shaft. The drive sleeve 120 is keyed to the drive shaft 86 so as to permit relative longitudinal translation therebetween while preventing relative rotation. In the illustrated embodiment, this is achieved by a keying member 122 having an outwardly projected keying tab 124. The keying member 122 is secured within a vertical slot 126 in the periphery of shaft 86. The tab 124 rides within a vertical slot 128 in the interior of sleeve 120 and interacts with the sides of the slot 128 to prevent relative rotation of the shaft and sleeve. Thus the shaft transmits torque and rotation from the pulley to the sleeve 120. To provide a smooth sliding vertical engagement between the drive shaft 86 and drive sleeve 120, a bearing having a cage 130 and a plurality of balls 132 is interposed between the inner cylindrical surface of the sleeve 120 and the outer cylindrical surface of the shaft 86.

A generally-annular elastomeric diaphragm 134 having an outer periphery 136 and an inner periphery 138 off an upper portion of the annular space 102 to form a pressure chamber 102A. The diaphragm has an upper surface 140A generally interior to the pressure chamber 102A and a lower surface 140B generally exterior to the pressure chamber. Along its inner periphery 138, the diaphragm is sealingly secured between an upward facing shoulder of the drive sleeve 120 and a lower face an annular internally threaded clamp 142. The clamp 142 (which may be formed as a nut) is engaged to an externally threaded reduced diameter portion 144 at the upper end of the drive sleeve 120. The diaphragm extends radially outward from between the clamp and shoulder and then curves downward along a round 146 formed between the shoulder and a cylindrical outer surface portion 148 of the drive sleeve. The diaphragm disengages the circular cylindrical outer surface portion and continues radially outward, traversing a gap (the annular space 102) between the drive sleeve and the collar. Continuing and curving upwardly, the lower surface 140B of the diaphragm engages a circular cylindrical inner surface 150 of the lower collar piece 100 and extends upward therealong. The diaphragm wraps over a round 152 formed between the cylindrical inner surface 150 and an upward facing shoulder of the lower collar piece and is clamped between the upward facing shoulder and a downward facing shoulder of the upper collar piece 98. Inboard of the inner cylindrical surface 150, an annular lip 154 projects downward from the upper collar piece, sandwiching a portion of the diaphragm between an outer cylindrical surface of the lip 154 and the inner cylindrical surface 150 of the lower collar piece.

In operation, the chamber 102A may be inflated to move the drive sleeve 120 and end effector 86 from the retracted position (FIG. 3A) to the extended position (FIG. 3B). The chamber may be deflated, such as by applying a vacuum through the rotary union 94, move the drive sleeve and end effector from the extended position to the retracted position. Because gravity naturally biases the end effector and drive sleeve toward the extended position, vacuum is provided for retraction. During transition between the retracted and extended positions, the lower surface 140B of the diaphragm rolls off the cylindrical outer surface 148 of the drive sleeve, traverses the gap formed by annular space 102, and rolls onto the cylindrical inner surface 150 of the lower collar piece. The amount of downforce applied to the end effector will be proportional to the pressure applied to the chamber. Optionally, a spring (not shown) may be provided to bias the drive sleeve toward the retracted position and, thereby, eliminate or reduce the need for applying a vacuum to retract the end effector.

Figure 4:
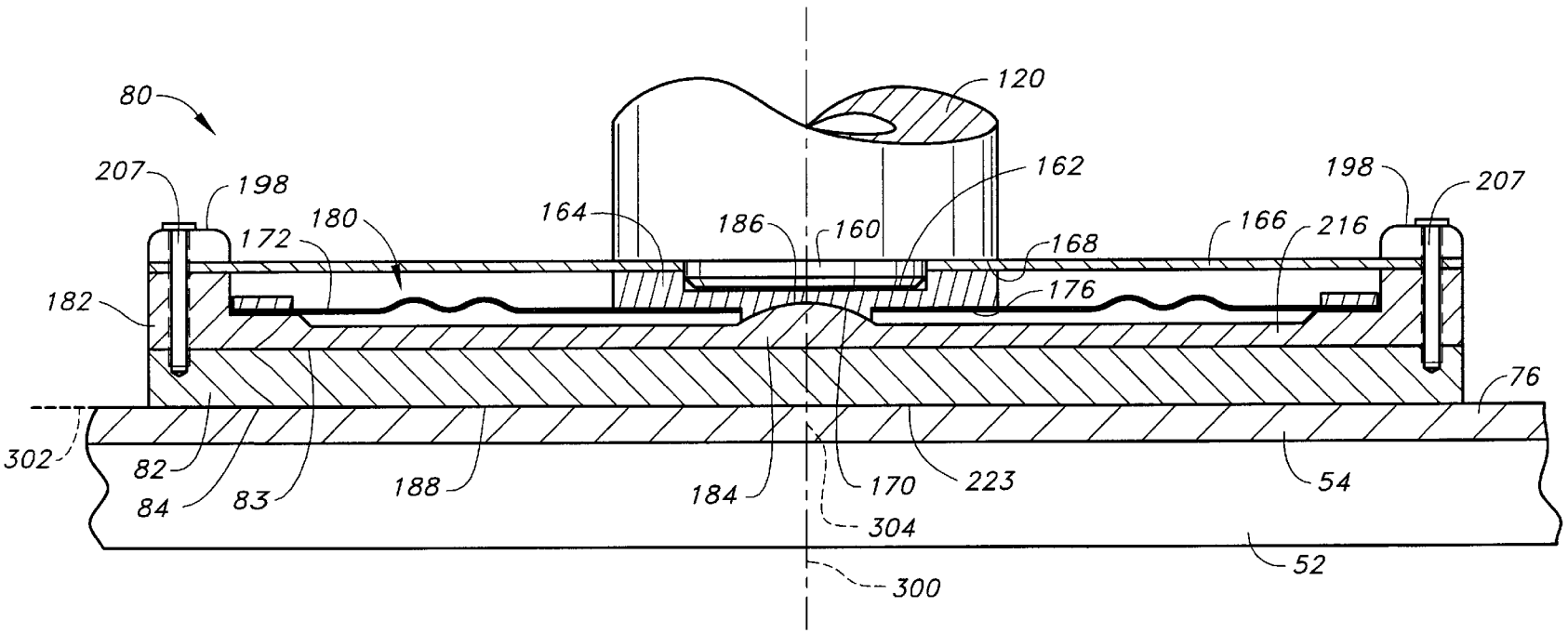
FIG. 4 is a diagrammatic cross-sectional view of the end effector of the conditioner head of FIGS. 3A and 3B.

The drive sleeve couples the end effector to the drive shaft to transmit torque and rotation from the drive shaft and downforce from the pressure chamber to the end effector shown in FIG. 4. The end effector 80 transmits the torque, rotation, and downward force to the conditioning disk 82. A central cylindrical projection 160 depends from the base of the drive sleeve 120 and is received by a cylindrical well 162 in a hub 164 of the end effector 80 and is secured thereto by means such as screws (not shown). A centrally-apertured annular elastomeric membrane cover 166 prevents contaminants from falling into the interior of the end effector. The cover 166 is clamped at its aperture between a horizontal shoulder 168 of the drive sleeve base and an annular surface of the top of the hub 164, outboard of the projection 160 and well 162. The cover 166 is also clamped at its edges between a clamp ring 198 and a disk holder 182. In the exemplary embodiment, the cover may be formed of ethylene propylene diene terpolymer (EPDM) rubber.

Figure 5:
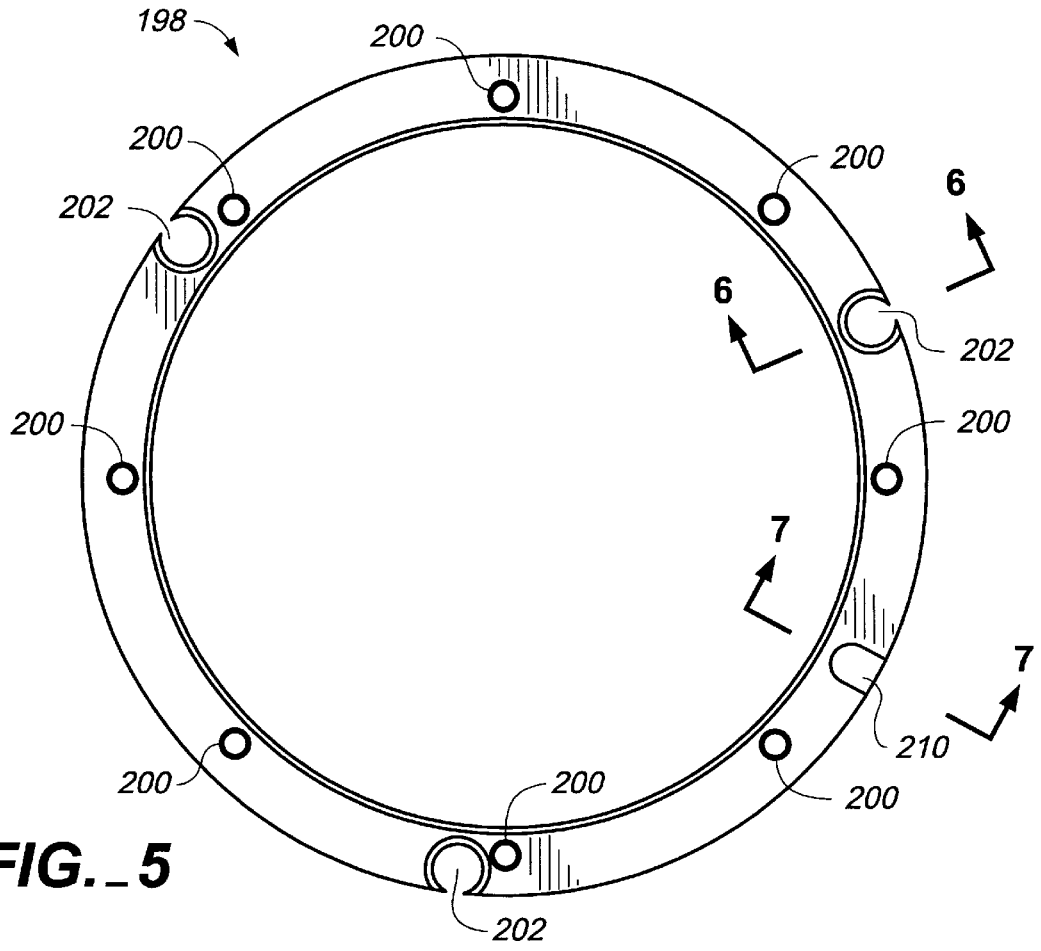
FIG. 5 is a top view of a clamp ring of the end effector of FIG. 4.
Figure 6:
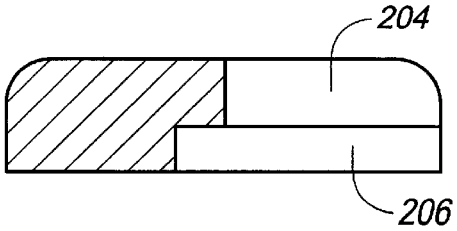
FIG. 6 is a cross-sectional view of the clamp ring of FIG. 5 taken along the line 6—6.
Figure 7:
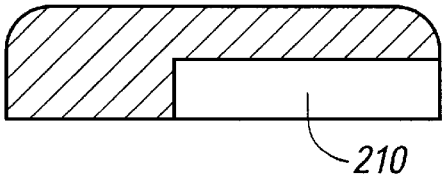
FIG. 7 is a cross-sectional view of the clamp ring of FIG. 5 taken along the line 7—7.

Referring to FIGS. 5, 6 and 7, the ring 198 includes a plurality of inner holes 200 arranged around the ring 198 and extend from an upper surface to a lower surface of the ring 198. The holes 200 are configured to receive a plurality of screws to clamp the edges of the cover 166 between the ring 198 and the disk holder 182. The ring 198 also includes a plurality of outer holes 202, outboard of the inner hole 200. The outer holes 202 extend from the upper surface to the lower surface of the ring 198. The holes 202 are configured to receive a plurality of mechanical fasteners, e.g., securing screws 207 (see FIG. 4), to secure the disk holder 182 to the disk 82. Providing the holes 202 on the ring allows for direct access to the screws 207, so that an operator can attach or detach the disk from the disk holder without first removing the cover 166 or other components positioned above the inner part of the disk holder.

Each of the holes 202 includes a generally annular upper cavity 204 and a generally annular lower cavity 206 extending further inward into the ring than the upper cavity 204 (FIG. 6). The lower cavity has slightly greater dimensions than the head of screw 207 to contain it therein. The upper cavity 204, however, has a smaller diameter than the head of the screw 207 to keep the screw 207 secured within the lower cavity 206. The ring 198 further includes an orientation depression 210 which is used to properly align the ring 198 to the disk holder 182 (FIG. 7). In the exemplary embodiment, the ring 198 has an outer diameter of about 4¼ inches, an inner diameter of about 3½ inches, and thickness of about ⅛ of an inch.

Figure 8:
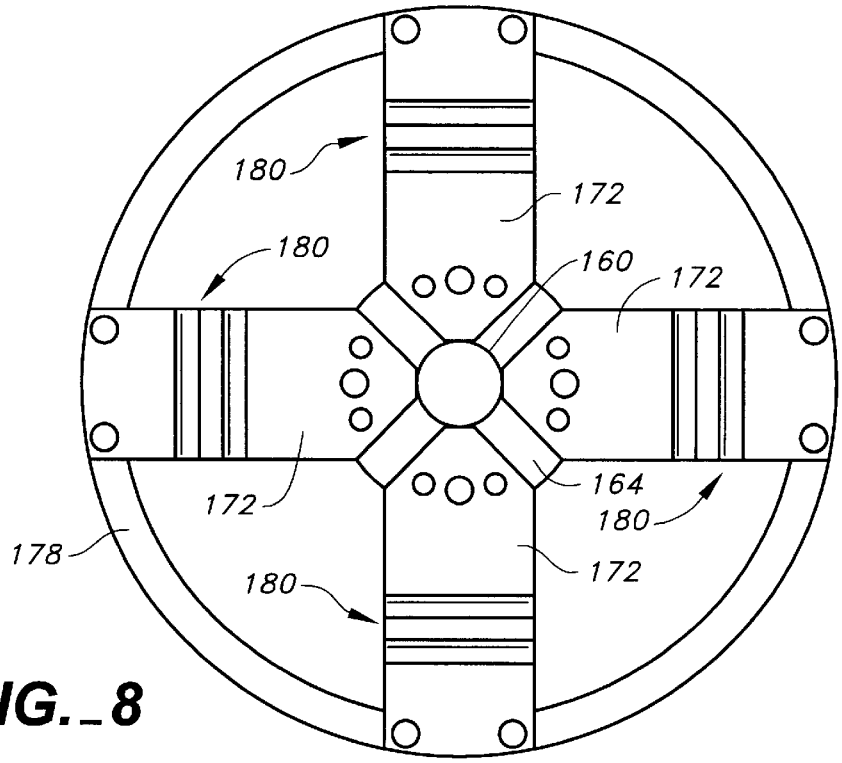
FIG. 8 is a top view of a plurality of spokes of the end effector of FIG. 4.

Referring back to FIG. 4, a central downward facing socket 170 having a concave spherical surface portion is formed in the bottom of the hub 164. In the illustrated embodiment, the socket is a sector comprising approximately 63.5° degrees of arc. Extending radially outward from the hub 164 are four generally flat sheet-like spokes 172 (see also FIG. 8), each oriented so as to have generally upper and lower surfaces. At the proximal end of each spoke, the spoke's upper surface is in contact with an annular downward facing shoulder 176 of the hub 164 radially outboard of the socket 170. Each spoke's proximal end is secured to the hub 164 such as by rivets, screws, or other fastening means (not shown). The distal ends of the spokes are secured to a flat horizontal annular band 178.

With their low profile, the spokes 172 are resiliently flexible upward and downward so as to permit tilting of the rim, relative to the axis 300 from the otherwise neutral horizontal orientation. However, the configuration of the spokes makes them substantially inflexible transverse to the axis 300, so that they effectively transmit torque and rotation about the axis 300 from the hub 164 to the inner rim 178. Optionally, to increase vertical flexibility without compromising lateral strength and ability to transmit torque, the spokes may each be provided with a transversely extending wave or ruffle 180. Three to five spokes are preferred to balance torque transmission and flexibility.

Figure 9:
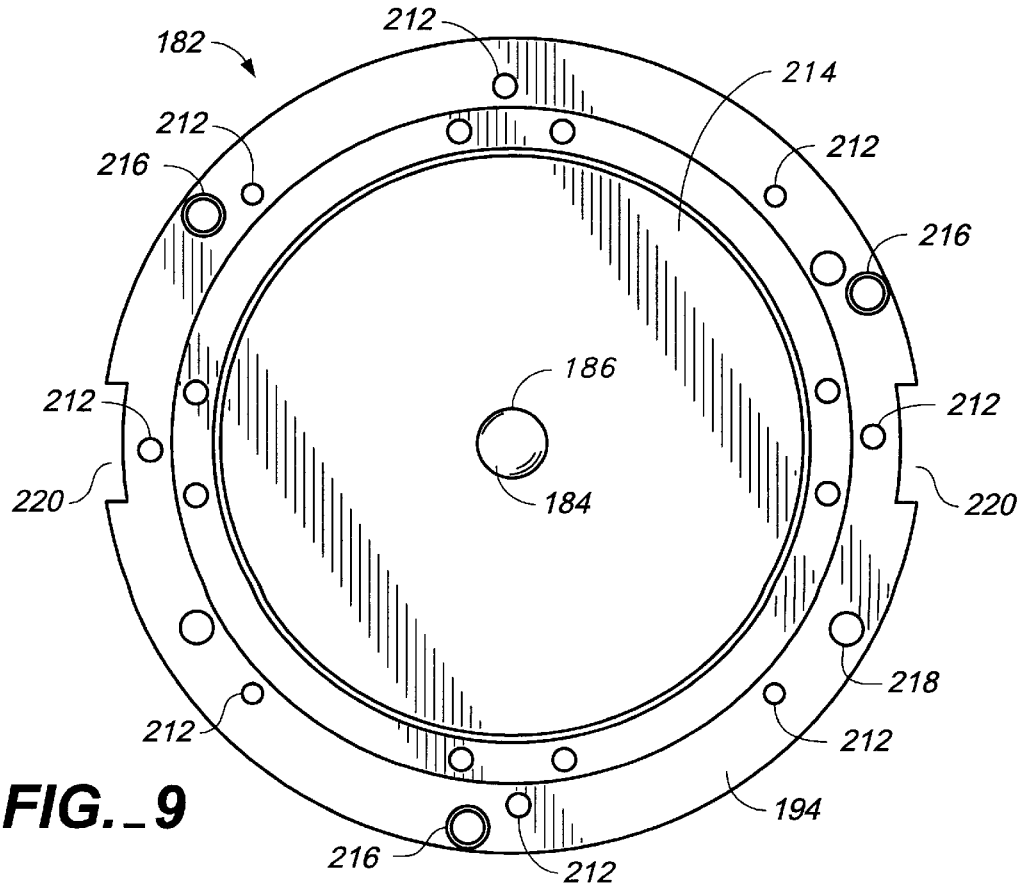
FIG. 9 is a top view of a disk holder of the end effector of FIG. 4.
Figure 10:
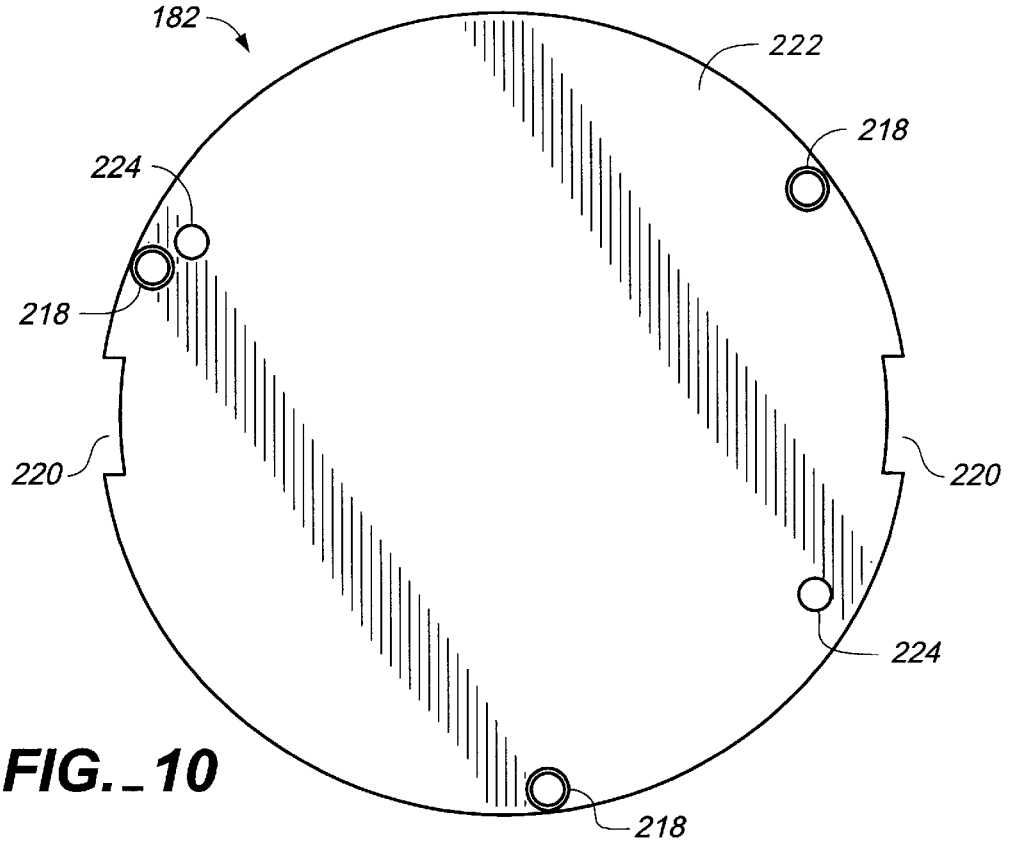
FIG. 10 is a bottom view of a disk holder of the end effector of FIG. 4.

Referring to FIGS. 4, 9 and 10, the disk holder 182 which is rigid and generally disk-shaped is provided immediately below the spokes. In an exemplary embodiment, the disk holder 182 is formed of polyethylene terepthalate (PET). The disk holder has a central upward facing projection 184 having a convex spherical surface portion 186 of equal radius to and in sliding engagement with the concave spherical surface portion of the socket 170. Interaction of the projection 184 and socket 170 can transmit compressive force between the drive sleeve 120 and the disk holder 182 while permitting the disk holder to rotate about axes orthogonal to the axis 300. The disk holder 182 has a generally flat lower surface or mounting surface 188 in contact with an upper surface 83 of the disk 82.

The disk holder 182 extends radially outward to a generally annular rim 194. The rim 194 is secured to the outer periphery of the cover 166 such as by screws extending through the holes 200 of the clamp ring 198. The screws are received by a plurality of cavities 212 provided around the rim 194 of the disk holder 182. An upwardly protruding orientation pin 218 is provided on the rim 194. The disk holder 182 and the ring 198 may be quickly aligned by inserting the pin 218 into the depression 210. A plurality of holes 216 which extend to the lower surface 222 of the disk holder 182 are also provided on the rim 194, outboard the cavities 212. The holes 214 correspond to the holes 206 of the ring 198 and are configured to receive the screws 207 to secure the disk 82 to the disk holder 182. The disk holder 182 further includes two indentations 220 at the edges to provide a grip for manually detaching the disk holder from the disk.

On the lower surface or the mounting surface, the disk holder 182 includes a plurality of drive pins 224 protruding downward at the periphery of the disk holder. In the exemplary embodiment, two drive pins 224 are provided, each on the opposing edges of the disk holder. When the disk holder 182 is mated to the disk 82, the drive pins 224 are received by associated bores 226 on an upper surface 228 of the disk (FIG. 11) and serve to prevent rotation of the disk 82 relative to the disk holder.

Figure 11:
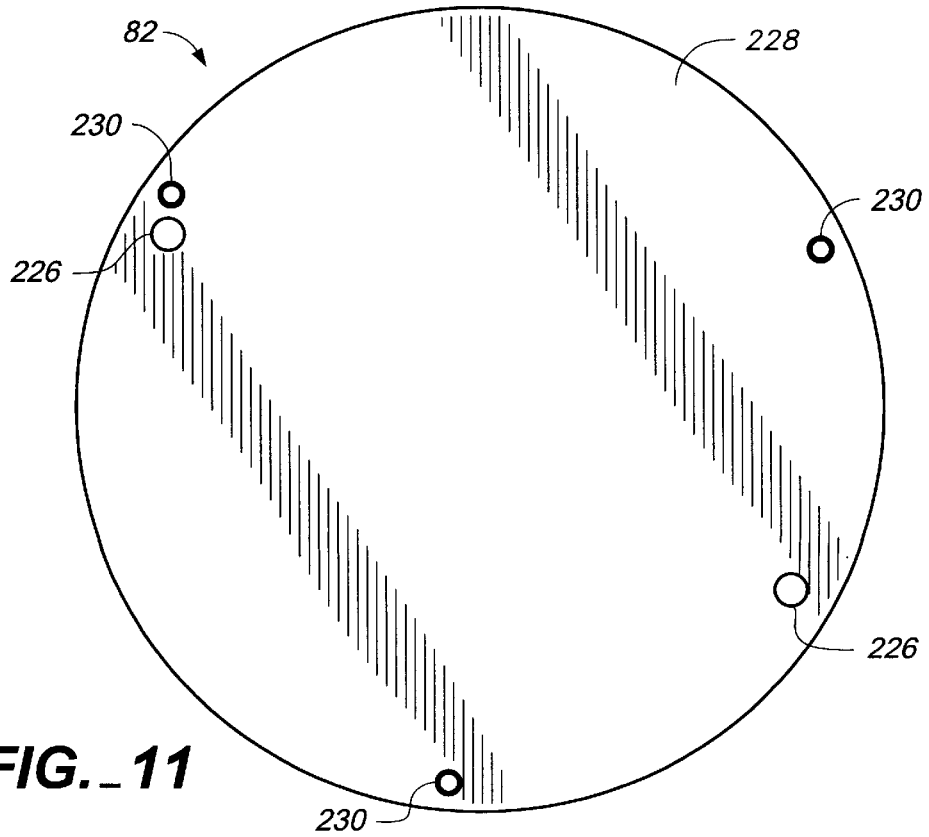
FIG. 11 is a top view of a disk of the end effector of FIG. 4.

Referring to FIG. 11, the disk 82 includes a plurality of cavities 230 corresponding to the holes 214 of the disk holder 182. The cavities 230 receives the screws 207 inserted into the hole 214 to secure the disk 82 to the disk holder 182. The disk 82 and the disk holder 182 are configured to receive the screws 207 at the periphery, so that the disk may be detached or attached to the disk holder removing the cover 166. A flat lower surface 84 of the disk 82 is embedded with diamond particles to abrade and condition the polishing pad.

In operation, with the conditioner head located above the polishing pad as described above, the drive shaft 86 is caused to rotate, transmitting torque to the disk 82. The end effector 80 is then shifted from the retracted position to an extended position to bring the lower surface 84 of the disk into engagement with the polishing surface 76 of the pad. The downward force compressing the disk against the pad is controlled by modulating the pressure in the pressure chamber 102A. The downward force is transmitted through the drive sleeve, the hub, between the concave and convex spherical surface portions to the disk holder and then to the disk. Torque to rotate the disk relative to the pad is supplied from the drive shaft to the drive sleeve, the hub, the spokes, the rim of the disk holder, and then to the disk via the drive pins. The rotating disk 82 is reciprocated in a path along the rotating polishing pad.

The end effector 80 is configured to maintain its lower surface flat against the polishing surface of the pad even if a precise perpendicular alignment between the axis 300 and the polishing surface 76 of the pad is not provided. For this purpose, the concave and convex spherical surface portions of socket 170 and projection 184, respectively, have a common center of curvature 304 at the intersection of a disk plane 302 (the flat lower surface 84 of the disk) with the longitudinal axis 300. In a neutral orientation, the disk plane is perpendicular to the longitudinal axis 300 which extends through the center of the disk.

If the polishing surface of the pad is not perpendicular to the axis 300, the disk, and disk holder may tilt relative to the axis via sliding of the convex spherical surface of the projection 184 relative to the concave spherical surface of the socket 170. The hub 164 remains fixed relative to the axis 300. To accommodate the tilt, the spokes 172 flex either upward or downward depending on their location at any given point in time. The location of the common center 304 in the disk plane 302 minimizes fluctuations in the compression force between the disk and the pad when the end effector 80 tilts to maintain engagement between the end effector and pad. The shear force applied to the disk by friction with the polishing pad is directed in the disk plane 302 and, thereby, does not exert a moment about the center 304 which would otherwise tend to pivot the disk and produce an uneven pressure distribution between the disk and pad. The cover 166 is free to flex and stretch to accommodate the tilting.

Figure 12:
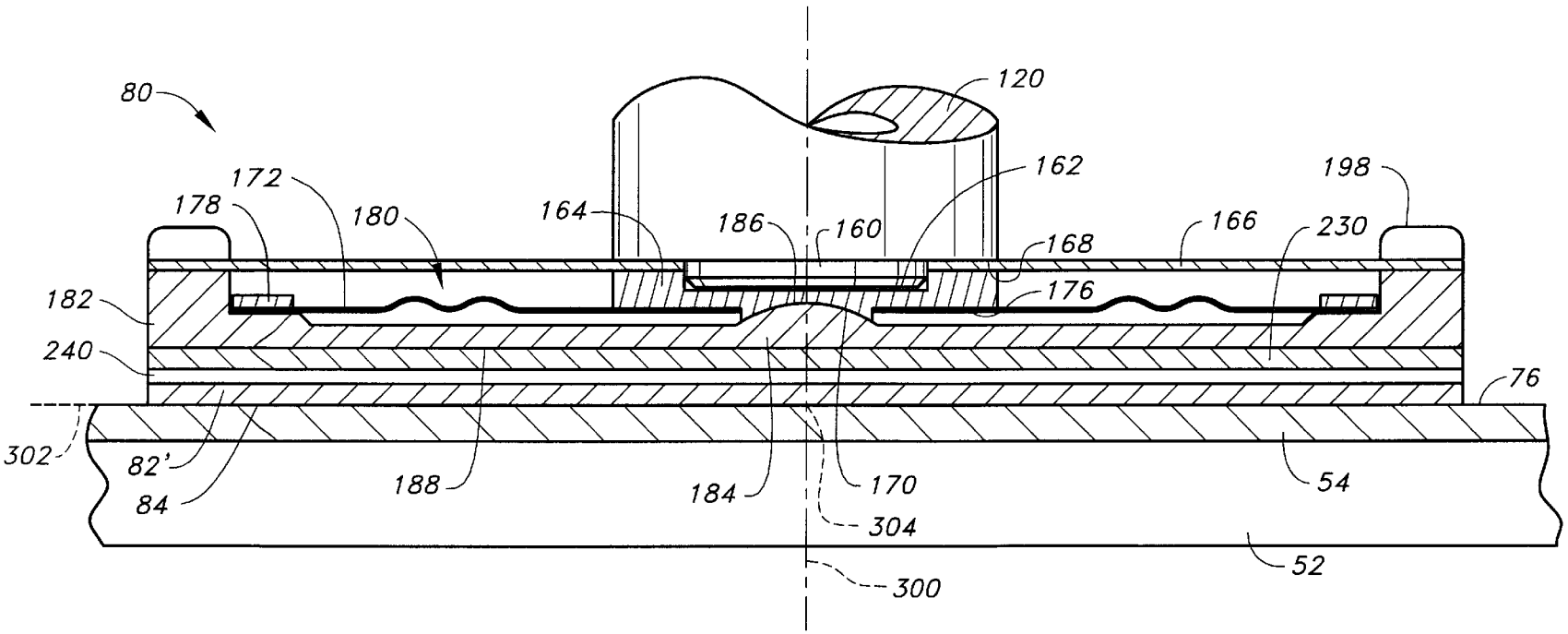
FIG. 12 is a diagrammatic cross-sectional view of an end effector having an adapter and a magnetic plate.

Referring to FIG. 12, the disk holder 182 may be used to hold a disk 82' manufactured by TBW while maintaining the common center of curvature 304 at the intersection of the disk plane 302 with the axis 300. The disk 82' is generally thinner than the disk 82, so that a generally annular, flat adapter 230 is secured between the disk holder 182 to compensate the thickness variation of the disk 82'. The upper surface of the adapter 230 has substantially identical configuration as with the upper surface 228 of the disk 82, as shown in FIG. 11. The adapter includes a plurality of holes (not shown) on its upper surface to receive the screws 207, so that the adapter may be secured to the disk holder. The adapter also has two bores (not shown), similar to the bores 226 of the disk 82, to receive the drive pins 224 of the disk holder. A generally annular, flat magnetic plate 240 is inserted between the adapter 230 and the disk 82' to magnetically secure the disk 82' to the adapter 230, which in turn is mechanically secured to the disk holder 182. The adapter 230 and the magnetic plate 240 are configured so that the total thickness of the adapter 230, the magnetic plate 240 and the disk 82' is substantially identical to the thickness of the disk 82. Thus, the common center of curvature 304 is maintained at the intersection of the disk plane 302 with the axis 300. The disk holder 182, therefore, may carry disks of varying thickness by using complementary adapters accordingly. The operation of the conditioner head 60 using the disk 82' is substantially identical to that of using the disk 82 described above.

Other embodiments are within the scope of the present invention. The scope of the invention is defined by the appended claims.

What is claimed is:

1. A conditioner head to condition the polishing surface of a polishing pad, comprising:

a disk having a first abrasive surface to contact a polishing pad, a second surface opposite the first surface, and a plurality of cavities provided around a periphery of the disk, the cavities formed in the second surface and extending only partly toward the first surface;

a disk holder to carry the disk and to hold the abrasive surface in contact with the polishing pad, the disk holder having a generally flat mounting surface to contact the second surface, and a plurality of holes provided around a periphery of the disk holder corresponding to the plurality of cavities formed in the disk, the holes extending through the disk holder;

a plurality of screws inserted through the plurality of holes into the plurality of cavities to secure the disk to the disk holder; and a drive element to rotate the disk about an axis.

2. A conditioner head to condition the polishing surface of a polishing pad, comprising:

a disk having an abrasive surface to contact a polishing pad;

a disk holder to carry the disk and to hold it in contact with the polishing pad, the disk holder having a generally flat mounting surface, an upwardly protruding rim, a ring positioned on the rim of the disk holder, the ring having a plurality of holes at an edge of the ring, and a membrane cover secured between the ring and the rim to prevent contaminants from entering into an interior of the disk holder; and a drive element to rotate the disk about an axis.

3. The conditioner head of claim 2, wherein each of the plurality of holes on the ring includes an upper cavity and a lower cavity, the lower cavity extending radially further into the ring than the upper cavity.

4. A conditioner head to condition the polishing surface of a polishing pad, comprising:

a disk having an abrasive surface to contact a polishing pad;

a disk holder to carry the disk and to hold it in contact with the polishing pad, the disk holder having a generally flat mounting surface and a generally convex spherical portion protruding upward on an opposing side of the mounting surface; and a drive element to rotate the disk about an axis.

5. A conditioner head to condition the polishing surface of a polishing pad, comprising:

a disk having an abrasive surface to contact a polishing pad;

a disk holder to carry the disk and to hold it in contact with the polishing pad, the disk holder having a generally flat mounting surface;

a plurality of drive pins on the mounting surface of the disk holder to transfer torque to the disk;

a plurality of drive bores on the disk to receive the drive pins; and a drive element to rotate the disk about an axis.

6. The conditioner head of claim 5, further including a generally annular, flat adapter positioned between the disk and the disk holder.

7. The conditioner head of claim 6, further including:

a plurality of second cavities provided around a periphery of the adapter to correspond to the plurality of holes of the disk holder; and a plurality of screws inserted into the plurality of holes and the plurality of second cavities to secure the adapter to the disk holder.

8. The conditioner head of claim 6, wherein the adapter includes a plurality of drive bores to receive the drive pins of the disk holder.

9. The conditioner head of claim 6, wherein the disk holder includes a generally convex spherical portion protruding upward on an opposing side of the mounting surface, wherein a generally flat lower surface of the disk secured to the adapter and the disk holder defines a disk plane, wherein the disk, the adapter and the disk holder are configured such that the center of the spherical portion is located substantially at the disk plane.

10. The conditioner head of claim 6, further including a magnetic plate positioned between the adapter and the disk to magnetically couple the disk to the adapter.

11. A disk holder of a conditioner head to carry and hold an abrasive disk against a polishing surface of a polishing pad, the disk holder comprising:

a generally convex spherical portion protruding upward from an upper surface of the disk holder;

a generally flat mounting surface provided on a lower surface of the disk holder; and a plurality of holes around a periphery of the disk holder, the holes configured to receive a plurality of screws which are used to secure the disk or an adapter to the mounting surface of the disk holder.

12. A conditioner head to condition the polishing surface of a polishing pad, comprising:

a disk having an abrasive surface to contact a polishing pad;

a disk holder to carry the disk and to hold the disk in contact with the polishing pad, the disk holder having a generally flat mounting surface on one side and a generally convex spherical portion protruding upward on an opposing side of the mounting surface;

a generally flat adapter secured to the disk on one side and mounted to the mounting surface of the disk holder on an opposing side thereof;

a drive element to rotate the disk about a longitudinal axis; and wherein a generally flat lower surface of the disk secured to the adapter and the disk holder defines a disk plane, wherein the disk, the adapter and the disk holder are configured such that the center of the spherical portion is located substantially at the disk plane.

13. A conditioner head to condition the polishing surface of a polishing pad, comprising:

a disk having an abrasive surface to contact a polishing pad;

a disk holder to carry the disk and to hold it in contact with the polishing pad, the disk holder having a generally flat mounting surface and a plurality of drive pins to transfer torque to the disk;

a generally annular, flat adapter positioned between the disk and the disk holder, wherein the adapter includes a plurality of drive bores to receive the drive pins of the disk holder; and a drive element to rotate the disk about an axis.

* * * * *